US008322660B2

(12) United States Patent
O'Connor

(10) Patent No.: US 8,322,660 B2
(45) Date of Patent: Dec. 4, 2012

(54) RELAY FOR TOY TRACK SET

(75) Inventor: Stacy Lynn O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/221,203

(22) Filed: Aug. 30, 2011

(65) Prior Publication Data

US 2012/0074267 A1 Mar. 29, 2012

Related U.S. Application Data

(63) Continuation of application No. 12/581,762, filed on Oct. 19, 2009, now Pat. No. 8,006,943, and a continuation-in-part of application No. 12/979,247, filed on Dec. 27, 2010, which is a continuation of application No. 12/111,168, filed on Apr. 28, 2008, now Pat. No. 7,857,679, application No. 13/221,203, which is a continuation-in-part of application No. 12/581,762, and a continuation-in-part of application No. 12/717,645, filed on Mar. 4, 2010.

(60) Provisional application No. 61/106,553, filed on Oct. 17, 2008, provisional application No. 60/926,583, filed on Apr. 27, 2007, provisional application No. 60/966,029, filed on Aug. 24, 2007.

(51) Int. Cl.
*A63H 19/32* (2006.01)

(52) U.S. Cl. ..... 246/415 A; 446/176; 446/180; 105/53; 105/54; 105/55; 105/56

(58) Field of Classification Search ..... 246/415 A; 446/176, 180; 105/53–56, 60, 63, 69
See application file for complete search history.

(56) References Cited

U.S. PATENT DOCUMENTS 1,235,771 A 8/1917 Dettra
2,385,724 A 9/1945 Olson
3,025,846 A 3/1962 Crosman
(Continued)

FOREIGN PATENT DOCUMENTS

WO 9303808 A1 3/1993
(Continued)

OTHER PUBLICATIONS

International Search Report for PCT/US2008/061820 dated Oct. 17, 2008.
(Continued)

*Primary Examiner* — Jason C Smith
(74) *Attorney, Agent, or Firm* — Cantor Colburn LLP

(57) ABSTRACT

A relay for a toy track set, the relay having, a first actuator in a first plane; a second actuator in a second plane vertically elevated from the first plane; a conduit fluidly coupling the first actuator to the second actuator; and a release mechanism moveably secured to the first actuator for movement between a first position and a second position wherein movement of the release mechanism from the first position towards the second position causes the first actuator to force a fluid through the conduit, wherein the fluid forced through the conduit by the first actuator causes the second actuator to actuate a second release mechanism, wherein the first actuator is coupled to a first vehicle track segment and the second actuator is coupled to a second vehicle track segment.

19 Claims, 7 Drawing Sheets

U.S. PATENT DOCUMENTS 3,148,478 A 9/1964 Miller
3,398,956 A 8/1968 Lukes
3,402,503 A 9/1968 Glass et al.
3,603,024 A 9/1971 Davis et al.
3,633,308 A 1/1972 Yang
3,734,500 A 5/1973 Cooper
3,751,847 A 8/1973 Neuhierl
3,777,391 A 12/1973 Barcus et al.
3,858,875 A 1/1975 Nemeth et al.
3,896,735 A 7/1975 Fischer
3,998,460 A 12/1976 Dyer
4,094,089 A 6/1978 Sano
4,128,964 A 12/1978 Ogasawara
4,140,276 A 2/1979 Halford
4,145,049 A 3/1979 Papazian, Sr.
4,219,198 A * 8/1980 Meyer et al. ..... 273/399
4,267,661 A 5/1981 Hanson
4,357,778 A 11/1982 Matsumoto et al.
4,383,688 A 5/1983 Prehodka
4,401,050 A 8/1983 Britt et al.
4,423,871 A 1/1984 Mucaro
4,479,650 A 10/1984 Neuhierl
4,509,760 A 4/1985 Goldfarb et al.
4,513,966 A 4/1985 Mucaro et al.
4,564,197 A 1/1986 Lambert et al.
4,605,230 A 8/1986 Halford et al.
4,639,236 A * 1/1987 McKay et al. ..... 446/430
4,661,080 A 4/1987 Goldstein et al.
4,715,843 A 12/1987 Ostendorff et al.
4,897,065 A * 1/1990 Fertig et al. ..... 446/63
4,932,917 A 6/1990 Klitsner
5,011,138 A 4/1991 Rankin
5,154,615 A 10/1992 Joubert
5,234,216 A 8/1993 Ostendorff
5,254,030 A * 10/1993 Ostendorff et al. ..... 446/430
5,299,809 A 4/1994 Evangelista et al.
5,370,571 A 12/1994 Bosch
5,499,940 A * 3/1996 Johnson et al. ..... 446/180
5,586,923 A 12/1996 Hippely et al.
5,775,016 A 7/1998 Chien
5,788,553 A 8/1998 Shivers et al.
5,816,887 A 10/1998 Rudell et al.
5,819,717 A * 10/1998 Johnson et al. ..... 124/65
5,871,385 A 2/1999 Hippely et al.
5,899,789 A 5/1999 Rehkemper et al.
6,007,402 A * 12/1999 Nelson, II ..... 446/176
6,099,380 A 8/2000 Rasmussen
6,170,754 B1 1/2001 Halford
6,241,573 B1 6/2001 Ostendorff et al.
6,358,112 B1 3/2002 Lambert et al.
6,435,929 B1 8/2002 Halford
6,478,654 B1 11/2002 Rehkemper et al.
6,676,480 B2 1/2004 Sheltman
6,783,419 B1 8/2004 Paukert et al.
6,913,508 B2 7/2005 Hornsby et al.
6,951,497 B1 10/2005 Ngan
7,036,307 B2 * 5/2006 Rehkemper et al. ..... 60/413
7,628,674 B2 12/2009 Nuttall et al.
7,794,301 B2 9/2010 Ostendorff et al.
7,819,720 B2 * 10/2010 Nuttall et al. ..... 446/444
7,892,068 B2 2/2011 Nuttall et al.
7,901,266 B2 3/2011 Ostendorff
2005/0191938 A1 9/2005 Sheltman et al.
2005/0287915 A1 12/2005 Sheltman et al.
2005/0287918 A1 12/2005 Sheltman et al.
2005/0287919 A1 12/2005 Sheltman et al.
2006/0286896 A1 12/2006 Bedford et al.
2006/0286897 A1 12/2006 Bedford et al.
2007/0049160 A1 * 3/2007 Matthes et al. ..... 446/444
2008/0268743 A1 10/2008 O'Connor et al.
2009/0071137 A1 * 3/2009 Harris ..... 60/325
2010/0096509 A1 * 4/2010 O'Connor ..... 246/415 A
2010/0273394 A1 * 10/2010 O'Connor et al. ..... 446/429

FOREIGN PATENT DOCUMENTS

WO 9949948 A1 10/1999
WO 2007025353 A1 3/2007
WO 2008134663 A1 11/2008
WO 2009036298 A2 3/2009

OTHER PUBLICATIONS

International Search Report for PCT/US2009/061192 dated May 10, 2010.
Written Opinion of the International Searching Authority for PCT/US2008/061820 dated Oct. 17, 2008.
Written Opinion of the International Searching Authority for PCT/US2009/061192 dated May 10, 2010.
International Search Report dated Jan. 18, 2012 for International Application No. PCT/US2011/034788.
Written Opinion dated Jan. 18, 2012 for International Application No. PCT/US2011/034788.

* cited by examiner

RELAY FOR TOY TRACK SET

CROSS REFERENCE TO RELATED APPLICATIONS

This is application is a continuation of U.S. Ser. No. 12/581,762 filed on Oct. 19, 2009 which claims the benefit of U.S. Provisional Patent Application Ser. No. 61/106,553 filed Oct. 17, 2008 the contents each of which are incorporated herein by reference thereto.

This application is also continuation in part of U.S. patent application Ser. No. 12/979,247 filed Dec. 27, 2010, which is a continuation of U.S. patent application Ser. No. 12/111,168 filed Apr. 28, 2008, now U.S. Pat. No. 7,857,679, which claims the benefit of U.S. Provisional Patent Application Ser. Nos. 60/926,583 filed Apr. 27, 2007 and 60/966,029 filed Aug. 24, 2007, the contents each of which are incorporated herein by reference thereto.

This application is also a continuation in part of U.S. patent application Ser. No. 12/581,762 filed Oct. 19, 2009, which claims the benefit of U.S. Provisional Patent Application Ser. No. 61/106,553 filed Oct. 17, 2008, the contents each of which are incorporated herein by reference thereto.

This application is also a continuation in part of U.S. patent application Ser. No. 12/717,645 filed Mar. 4, 2010, the contents of which are incorporated herein by reference thereto.

BACKGROUND

Various embodiments of the present invention are related to toys in particular, a relay for actuating mechanisms of the toy.

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, various track amusement features have been added to the track sets. For example, track features, such as stunt devices or elements, including loops, jumps, collision intersections, etc., have been included in such track sets to increase the play value of the track sets.

However, with many track sets, the vehicles run on a closed loop track moving through the same track features lap after lap. Although such track sets may have one or more stunt devices, a vehicle in the track set may perform the same stunt over and over as it travels along the track. Thus, even in track sets with more than one stunt device, the motion of the vehicle generally remains consistent for each vehicle as it travels along a specific section of the track. This repetitive nature of vehicle travel may result in loss of interest in the track set over a short period of time.

Some track sets have incorporated switching mechanisms to enable a user to direct a vehicle to a select travel path. However, generally such systems require manual manipulation of the track and/or manual actuation of a switch to reroute one or more vehicles traveling on the track. Play possibilities may be limited as travel along the select paths may again become repetitive over a short period of time.

Accordingly, it is desirable to provide toy track set with interchangeable elements and/or relays to provide numerous configurations.

SUMMARY OF THE INVENTION

In one embodiment, a relay for a toy track set is provided, the relay having a first actuator in a first plane; a second actuator in a second plane vertically elevated from the first plane; a conduit fluidly coupling the first actuator to the second actuator; and a release mechanism moveably secured to the first actuator for movement between a first position and a second position wherein movement of the release mechanism from the first position towards the second position causes the first actuator to force a fluid through the conduit, wherein the fluid forced through the conduit by the first actuator causes the second actuator to actuate a second release mechanism, wherein the first actuator is coupled to a first vehicle track segment and the second actuator is coupled to a second vehicle track segment.

In another embodiment a track set having a plurality of relays each with a first actuator and a second interchangeable actuator is provided. Here, an interchangeable toy track has a plurality of interchangeable relay segments each of which may be coupled to each other to create a plurality of variations for the toy track set and each of plurality of interchangeable relay segments having a first actuator in a first plane; a second actuator in a second plane vertically elevated from the first plane; a conduit fluidly coupling the first actuator to the second actuator; and a release mechanism moveably secured to the first actuator for movement between a first position and a second position wherein movement of the release mechanism from the first position towards the second position causes the first actuator to force a fluid through the conduit, wherein the fluid forced through the conduit by the first actuator causes the second actuator to actuate a second release mechanism.

DETAILED DESCRIPTION

Reference is made to the following U.S. patent application Ser. No. 12/111,168 filed Apr. 28, 2008, which claims the benefit of U.S. Provisional Patent Application Ser. Nos. 60/926,583 filed Apr. 27, 2007 and 60/966,029 filed Aug. 24, 2007, the contents each of which are incorporated herein by reference thereto.

Figure 1:
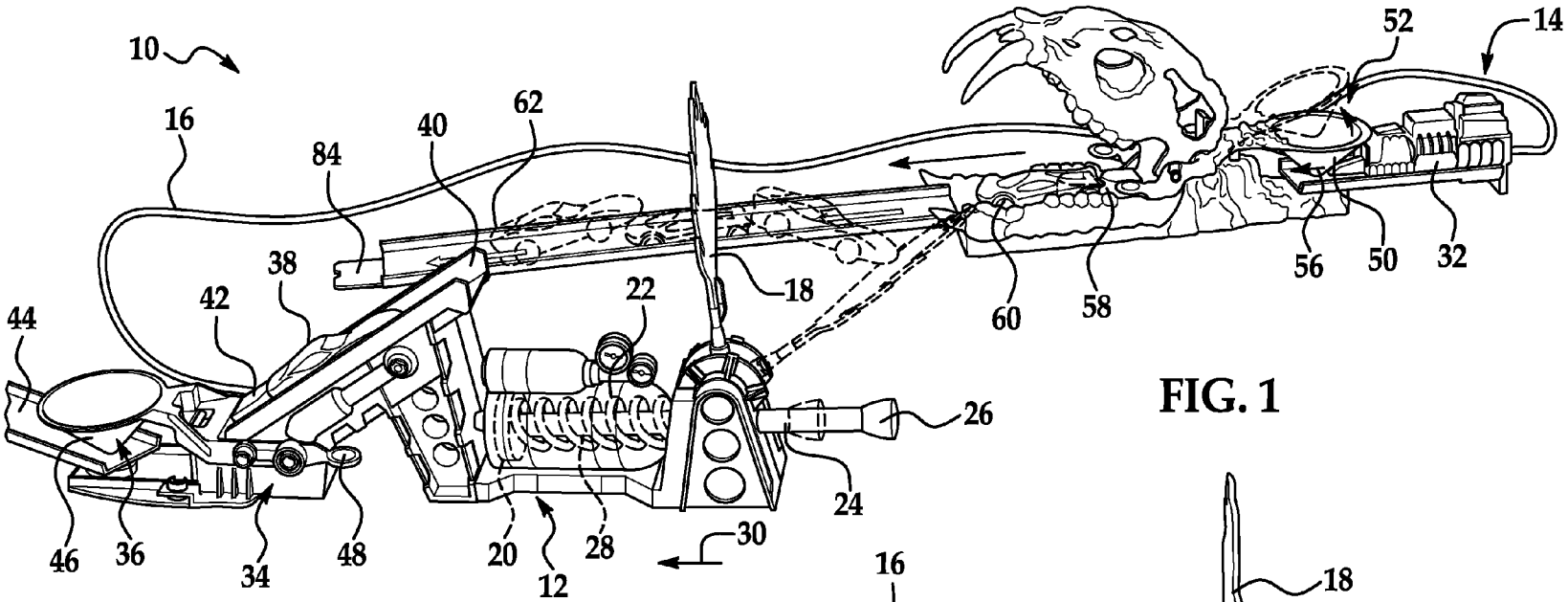
FIG. 1 is a perspective view of a relay in accordance with an exemplary embodiment of the present invention.
Figure 2:
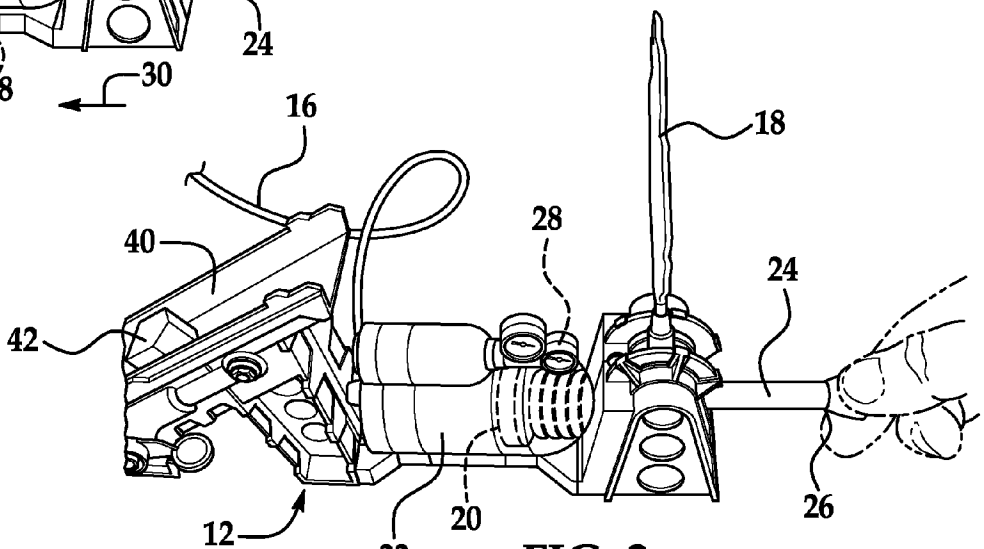
FIG. 2 is a perspective view of a first actuator of the relay of the embodiment illustrated in FIG. 1 in a first position.
Figure 3:
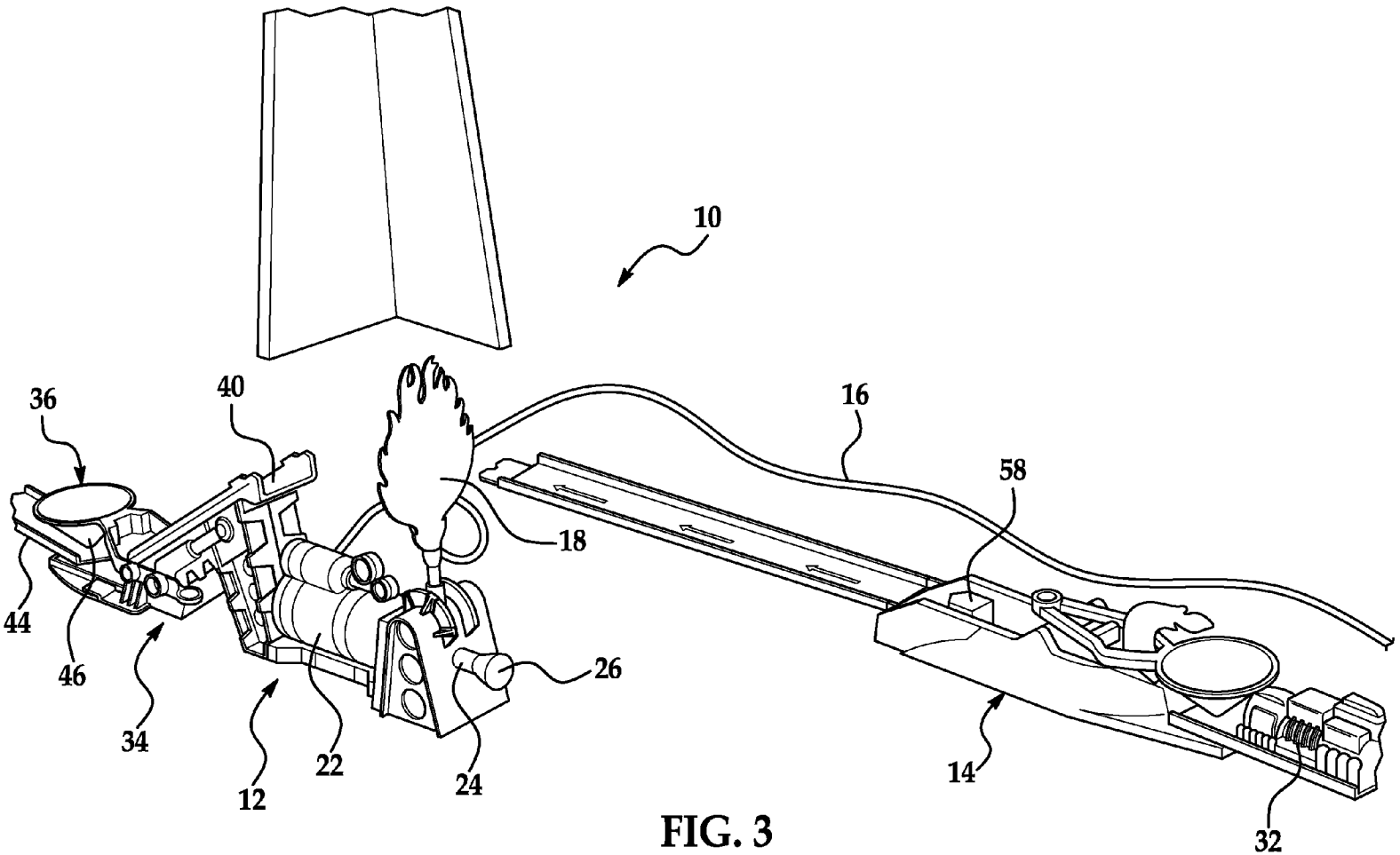
FIG. 3 is another perspective view of a relay.
Figure 4:
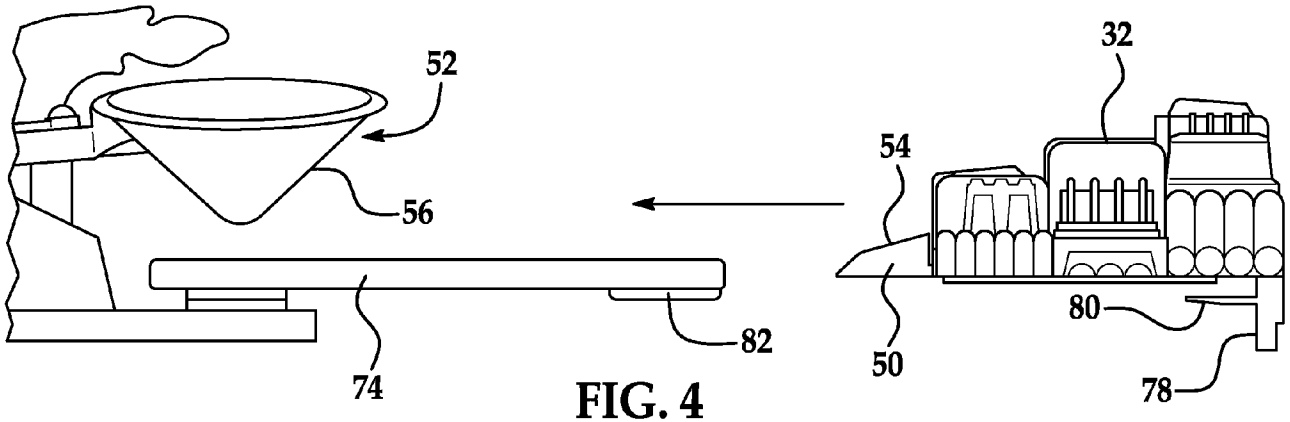
FIG. 4 is a side view of a second actuator of the relay illustrated in FIG. 1.
Figure 5A:
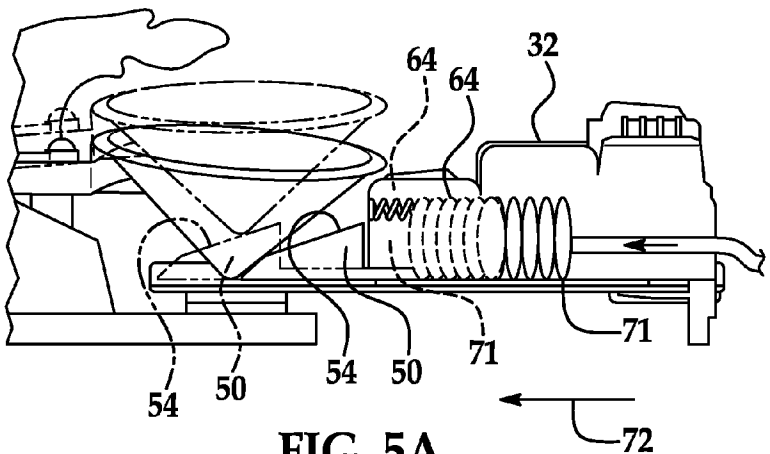
FIGS. 5 and 5A illustrate movement of the second actuator.
Figure 5:
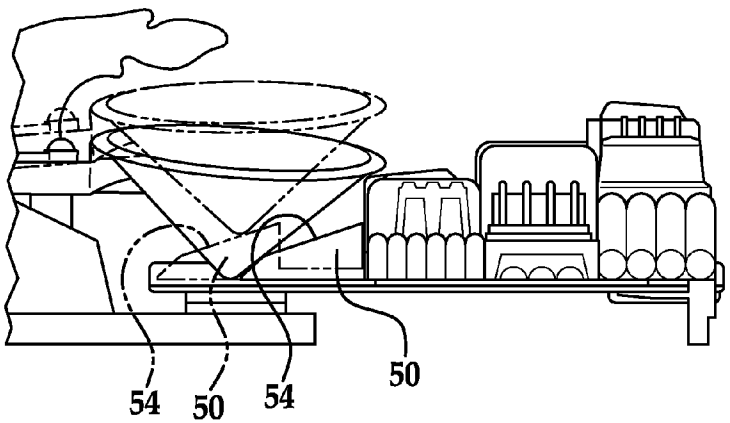

In accordance with various embodiments of the present invention a relay 10 for a customizable track set is provided. In one embodiment, the relay of the track set includes an interchangeable actuator, the interchangeable actuator being configured to be coupled to other track segments in order to create a customized expandable track set. In one embodiment and as illustrated in FIG. 1, the relay comprises a first actuator 12 coupled to a second actuator 14 by a conduit 16. Conduit 16 provides a means for fluidly coupling the first actuator to second actuator. Here the second actuator is the interchangeable actuator configured to be secured to any one of a plurality of track segments.

The first actuator has a release mechanism 18 configured for movement between a first position and a second position wherein the first position corresponds to a cocked position of a piston 20 slidingly received within a cylinder or chamber 22 of the first actuator that is in fluid communication with one end of the conduit via an exhaust manifold of the cylinder. In one embodiment of the present invention the piston 20 has at least one O-ring or sealing member 21 that allows the piston to slide within the cylinder while also preventing or limiting fluid communication therethrough (e.g., maintaining or preventing fluids or gases on one side of the piston from passing around the piston to another side of the piston).

Figure 6:
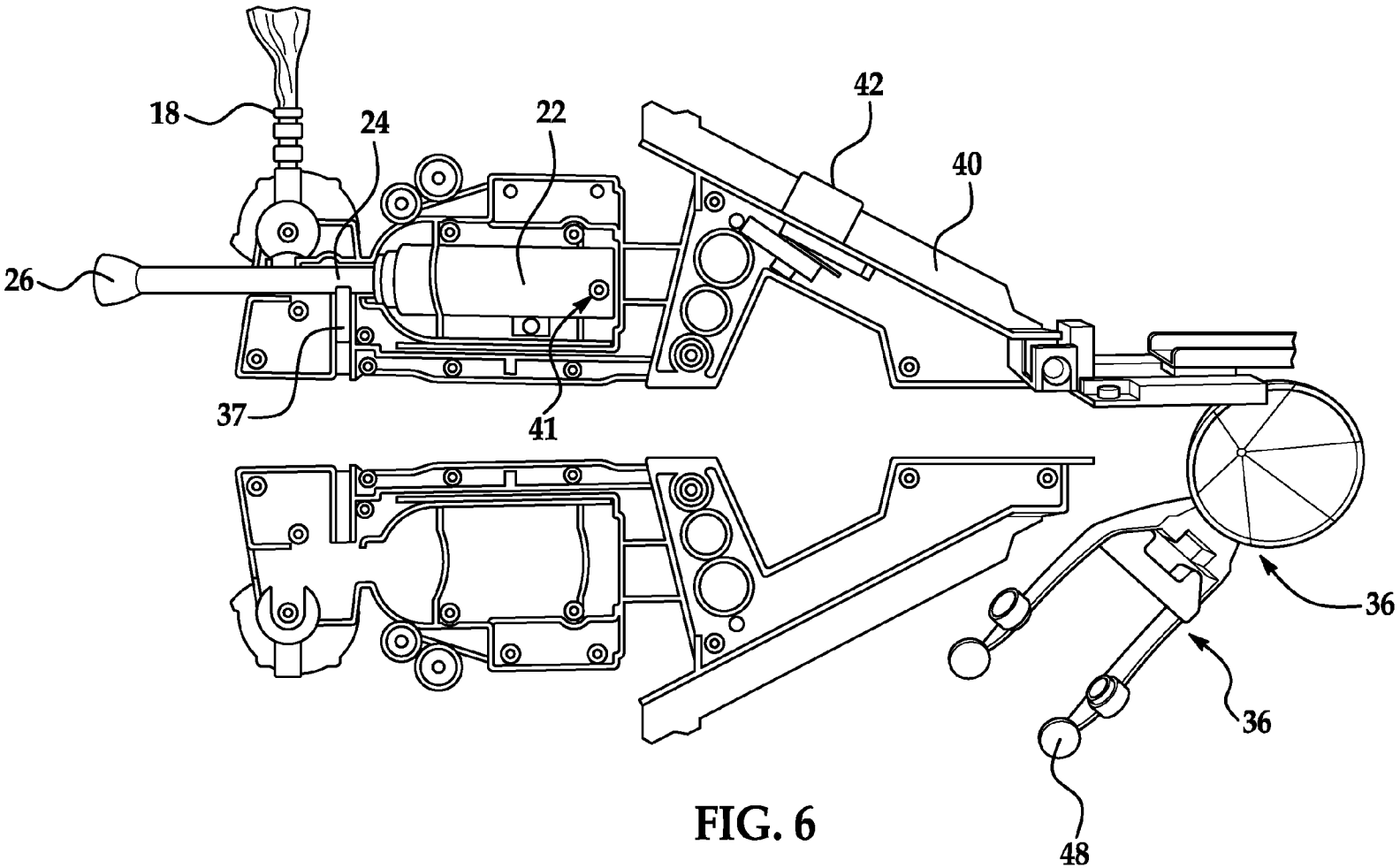
FIGS. 6-6D are disassembled views of the first actuator.
Figure 6A:
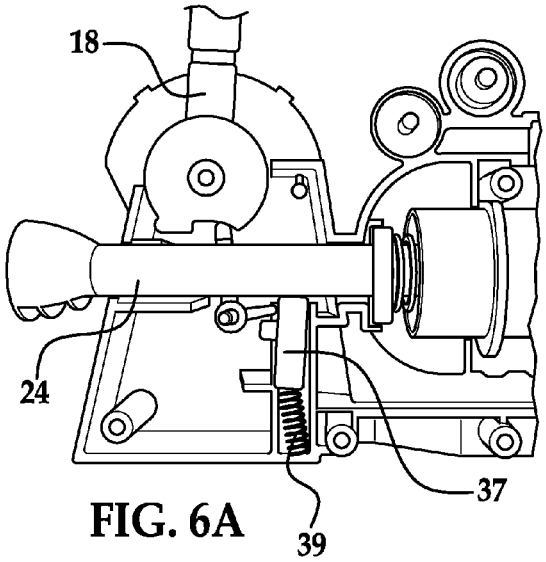
Figure 6B:
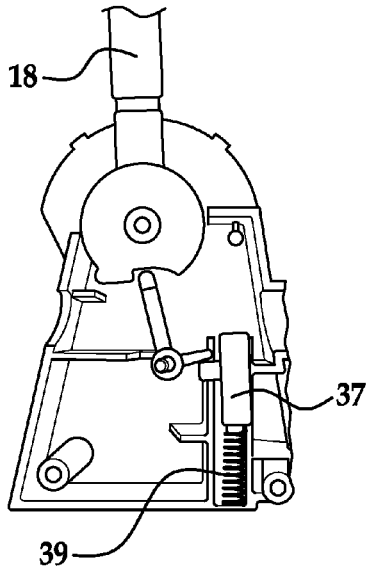
Figure 6C:
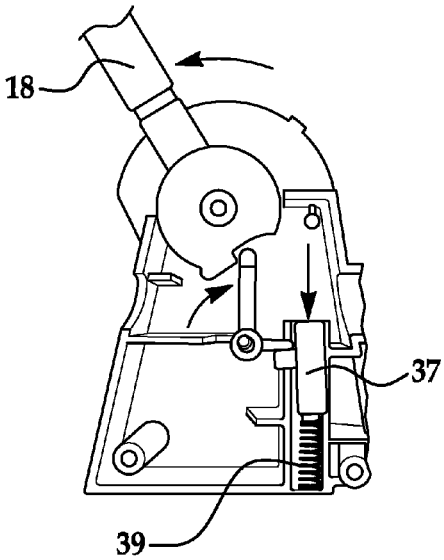
Figure 6D:
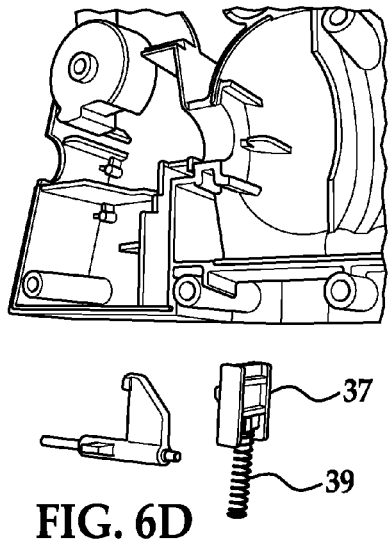
Figure 7:
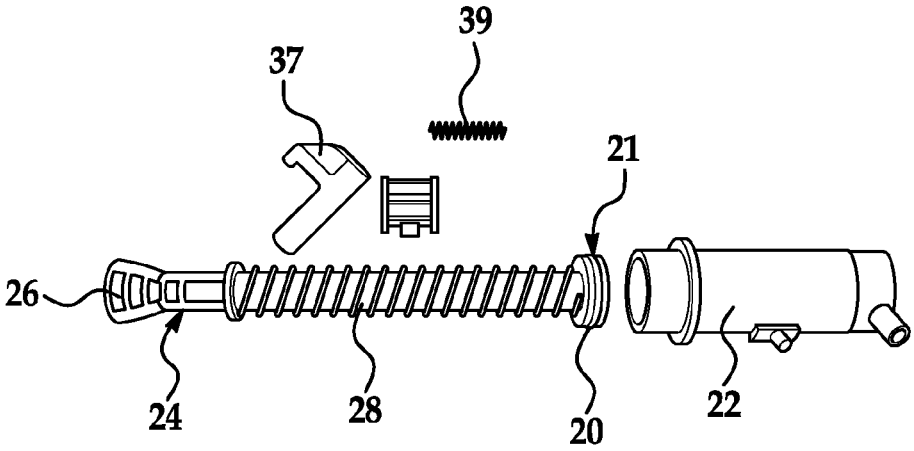
FIG. 7 is a perspective view of components of the first actuator.

The piston is secured to a rod or member 24 that is slidably mounted to the first actuator and is capable of movement between a cocked position and a released position (illustrated by the dashed lines in FIG. 1 see also FIGS. 6 and 7). Rod or member 24 has a knob portion 26 capable of being grasped by a user's hand in order to slide the rod and accordingly the piston from the released position to the cocked position. As the rod is slid or moved from the released position to the cocked position a spring or biasing member 28 is compressed such that a biasing force in the direction of the arrow 30 is provided such that release of the rod from the cocked position by movement of the release mechanism allows the biasing force of the spring to urge or move the piston in the direction of arrow 30 such that a force of compressed air is supplied to conduit 16 fluidly coupled to chamber 22. This force of compressed air is used to actuate an actuator 32 of the second actuator.

As illustrated, conduit 16 allows the first actuator to be remotely positioned with respect to the second actuator wherein the only item coupling the two together is conduit 16 furthermore, and in one embodiment conduit 16 is a flexible tube that allows various placements of the first actuator with respect to the second actuator.

First actuator 12 further comprises an actuating mechanism 34 for actuating or moving the release mechanism 18 from the first position towards the second position. In one non-limiting embodiment actuating mechanism 34 comprises a conically shaped trigger 36 pivotally secured to the first actuator for movement between an un-actuated and actuated or release position when the conically shaped trigger is pivoted from the un-actuated position to the actuated position to move the release mechanism from the first position to the second position causing compressed air to be provided to a second actuator. In one non-limiting exemplary embodiment, movement of the conically shaped trigger 36 from the un-actuated position to the actuated position causes a vehicle 38 to be launched from a ramp 40 by a spring biased actuator or launcher 42 wherein the car flies through the air and contacts a surface of the release mechanism causing the same to be pivoted from the first position towards the second position such that the force of spring 28 is released and compressed air is provided to the second actuator in order to actuate the actuator of the second actuator. Non-limiting examples of launchers for launching toy vehicles are well known to those skilled in the art. For example, exemplary launchers for toy vehicles are described in U.S. Pat. No. 4,108,437 entitled "Toy Vehicle Starting and Launching Set", issued on Aug. 22, 1978 and U.S. Pat. No. 6,435,929 and U.S. Patent Publication No. 2007/0293122 entitled "Track Set", filed on May 4, 2007, the contents each of which are incorporated herein by reference thereto.

Operation of the conically shaped trigger 36 is similar to that of U.S. patent application Ser. No. 12/111,168 filed Apr. 28, 2008 the contents of which are incorporated herein by reference thereto. As illustrated, a first track segment 44 is secured to the first actuator 12 such that a toy vehicle traveling along the first track segment will make contact with a conical surface 46 of the conically shaped trigger 36. In one embodiment and in order to provide various track set ups, the first track segment can be pivotally secured to the first actuator proximate to the conically shaped trigger 36 of the first actuator. Also shown is a manual actuating lever 48 and is coupled to the conically shaped trigger 36 and is capable of manually releasing the same such that vehicle 38 can be launched at release mechanism 18. Although a conically shaped trigger 36 is illustrated on first actuator 12 it is understood that any other type of trigger can be employed to cause the required movement of release mechanism 18 in order to provide a charge of compressed air to conduit 16. Furthermore, it is also understood that any object may be launched at release mechanism 18 by a trigger 36 and exemplary embodiments are not limited to launching a toy vehicle at release mechanism 18.

Figure 8:
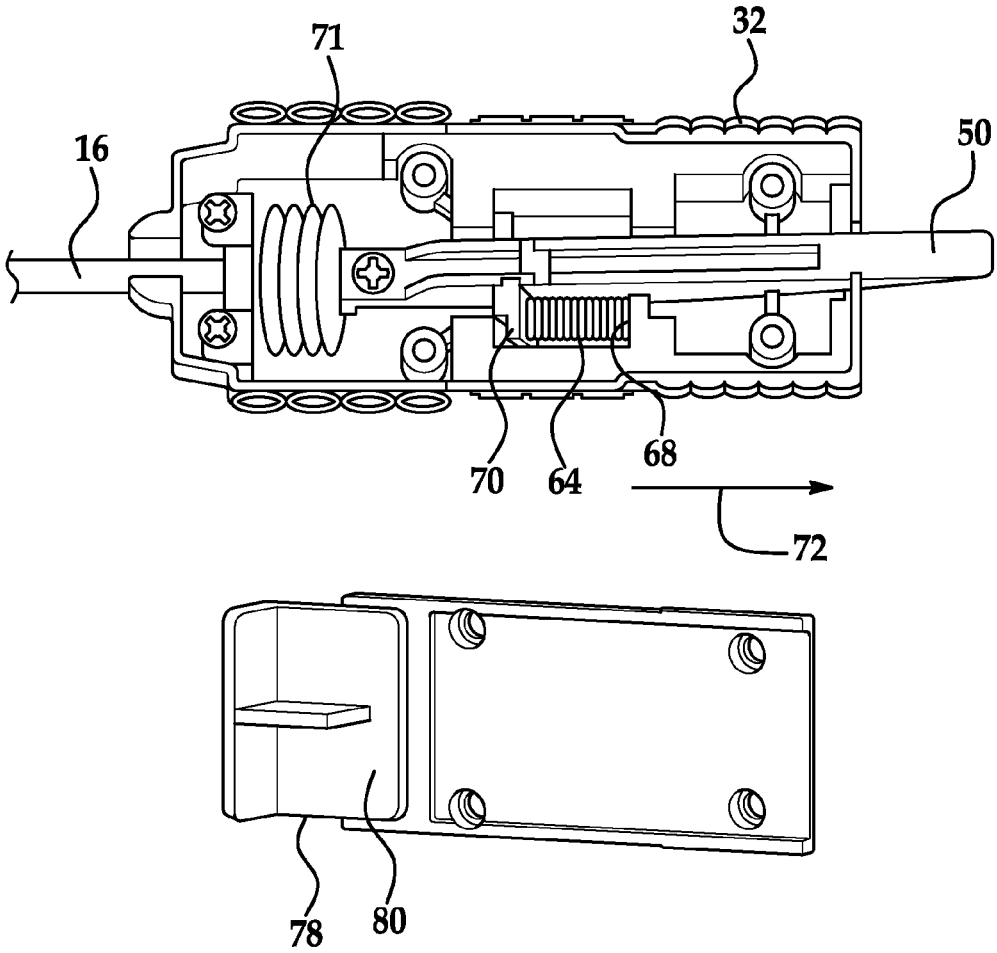
FIG. 8 is a disassembled view of the second actuator.

In order to cock or load the first actuator, a user pulls on the rod until a release latch 37 of the release mechanism engages or holds the rod in place. In one embodiment, the release latch 37 is biased into a locking position by a spring 39 wherein movement of the release mechanism causes the release latch to no longer engage the rod and allow the piston to travel in the chamber of the cylinder. This pulling of the rod fills the cylinder with air by drawing it in from an exhaust opening 41 and spring 28 is compressed. Alternatively, air may be drawn in from a one-way check valve. Upon stunt activation the car or object is launched at the release mechanism causing the release latch to release spring and push a volume of air into a bellows 71 of the second actuator to fill it up. As illustrated the bellows is fluidly coupled to the chamber 22 via flexible conduit 16 thus as a fluid is compressed in chamber 22 via piston 20 the compressed fluid is released into the bellows to cause it to expand and have a desired movement at the actuator 32. As the bellows is filled it expands and pushes the lever of the second actuator outward and the conical trigger is pushed upward to release another stunt or car associated with the second actuator. Although a bellows is illustrated any other type of chamber is contemplated wherein the same is capable of expanding when it receives the air forced out of chamber 22 by piston 20. Furthermore any other type of gas operated or pneumatically operated device may be employed to provide the necessary movement to movable member 50. Note bellows 71 is shown in an unexpanded or unfilled state in FIG. 8. It is also understood that any type of fluid may be used in the system comprising the bellows, the chamber and the conduit. Also, the system may be a closed system with additional valves, as required, for limiting and allowing fluid flow.

Referring now to FIGS. 1-5 interaction or operation of the first actuator and the second actuator will now be now described. As shown, conduit 16 is coupled to chamber 22 via an exhaust manifold 41 such that upon actuation of release mechanism 18 when rod 24 is in the cocked position, piston 20 will be urged in the direction of the arrow 30 and cause a fluid or charge of compressed air to be provided to actuator 32.

Actuator 32 has a movable member 50 with an angled surface for engaging a conically shaped trigger or release mechanism 52 pivotally secured to the second actuator 14. Actuator 32 is configured such that receipt of a charge of compressed gas from chamber 22 of the first actuator 12 will cause movable member 50 to move from an un-actuated position to an actuated position wherein a contact surface 54 of the movable member engages a conically shaped surface 56 of the conically shaped trigger 52 such that conically shaped trigger 52 moves upwardly and releases another spring biased actuator 58 that launches an object such as a vehicle 60 along a track segment 62 secured to the second actuator. In one embodiment the movable member 50 is biased into the un-actuated position by a spring 64 disposed within actuator 32 and disposed between a surface 68 of the actuator and a surface 70 of a moveable member secured to the bellows 71 such that the charge of compressed fluid, gas or air inflates the bellows in order to overcome the spring or biasing member 64 and urge the movable member 50 in the direction of arrow 72 thus causing the conical trigger 52 to move upward and launch object 60 down track segment 62. Although object 60 is illustrated as a toy vehicle traveling along a track segment exemplary embodiments of the present invention are not specifically limited to toy vehicles as it is contemplated that other objects may be launched or other actuators may be triggered by movement of the movable member 50 of actuator 32. Although actuator 32 is shown with a bellows for actuating the moveable member other means for actuating the moveable member are contemplated for example, the compressed air can be applied to a release mechanism for releasing a spring biased force.

In one embodiment and in order to secure actuator 32 to track segment 74 the actuator is configured to have a dimension capable of allowing the same to be slidably received within track segment 74 such that actuator 32 can be connected to any one of a plurality of track segments secured to any one of a plurality of relays illustrated herein and as well as those illustrated in U.S. patent application Ser. No. 12/111,168 the contents of which are incorporated herein by reference thereto such that the compressed gas of the first actuator can be applied to a second actuator, which can be secured to any one of a plurality of relay segments for example an actuator 32 illustrated in FIG. 6. In order to facilitate the securement of actuator 32 to a track segment an engagement feature or features 78 is/are provided. Engagement features 78 are configured to have a tongue portion 80 configured to be slidably received within a slotted opening 82 disposed on track segment 74 such that actuator 32 can be installed on any one of a plurality of track segments having a slotted portion configured to engage a tongue portion of another track segment for example, tongue portion 84 illustrated in FIG. 1. Accordingly, the output of the first actuator can be applied to the second actuator 32 that can be installed in any one of a plurality of relay segments creating a second actuator.

Figure 9:
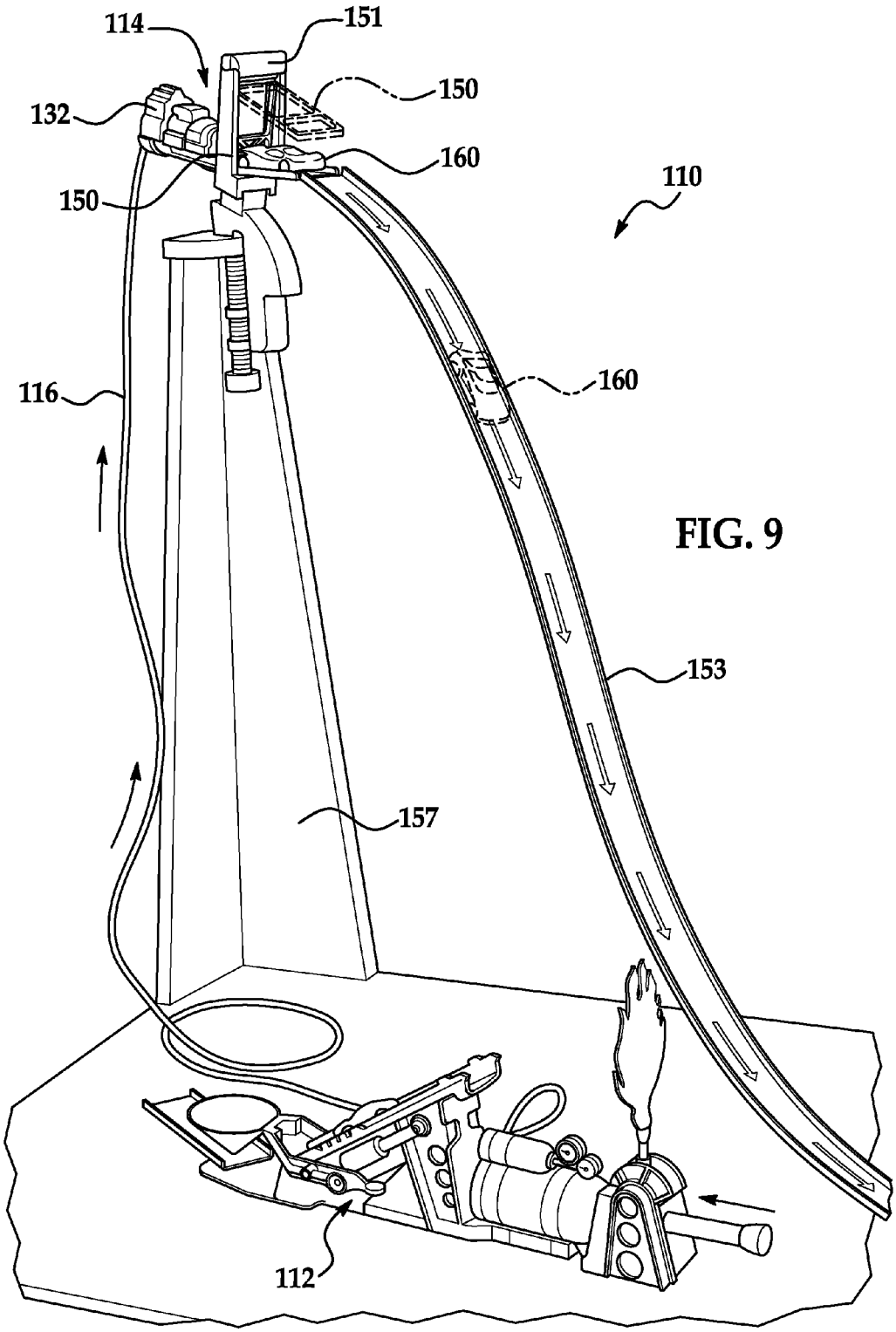
FIG. 9 is perspective view of an alternative exemplary embodiment of the present invention.

Referring now to FIG. 9 an alternative relay 110 is illustrated. Here relay has a first actuator 112 similar to actuator 12 of FIGS. 1-8. First actuator 112 also has a piston chamber fluidly coupled to a flexible conduit 114 such movement of the release mechanism from a first position to a second position when the rod is cocked (e.g., spring 28 is compressed and the release latch is engaging the rod) causes the rod and spring to be released such that compressed gas is released into the bellows of second actuator 114 and moveable member 150 pivots on a frame portion 151 of second actuator such that a car or object 160 is launched down a track 153 that is secured to the second actuator. As illustrated, the second actuator is secured to a tower or any other equivalent object 157 such that second actuator of the relay is elevated from the first actuator such that the object or vehicle launched by the first actuator does not need to physically contact the trigger of the second actuator. In this embodiment, once launched the vehicle will travel down the track via gravity. As shown, the second actuator is secured to the tower via a clamp or any other easily operated removable securement means to allow for numerous track configurations.

In accordance with various embodiments of the present invention each actuator may include one or more stunt elements and may be selectively positioned at the beginning, middle, or end of the track set. Each actuator may be configured to enable a toy vehicle to traverse an obstacle and/or perform a stunt and launch the toy vehicle down a track towards another relay segment, which then may initiate a second vehicle to be released and traverse still another obstacle and/or perform still another stunt.

Non-limiting examples of track set relay segments are found in U.S. patent application Ser. No. 12/111,168 the contents of which are incorporated herein by reference thereto. As discussed, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. In this way, a user can experience diverse track play and excitement time and time again.

In one example, the relay segments may include triggers, such as conical shaped triggers or angled trigger shapes that are not necessarily conical. As an example, conically shaped trigger may have a cone angle of approximately 45 degrees, which is actuated vertically via contact with a horizontally moving incoming vehicle. It should be appreciated that the cone angle may be of any suitable angle such that an incoming vehicle actuates the trigger. Thus, as a non-limiting example the cone angle may be anywhere from 5-90 degrees.

Further, the illustrated embodiments show a conical trigger, alternatively, the trigger may be planar shaped and angled (e.g., approximately 45 degrees) relative to an incoming track.

Although the figures illustrate a single relay with a first actuator and a second interchangeable actuator is contemplated that track sets having a plurality of relays each with a first actuator and a second interchangeable actuator are considered to be within the scope of exemplary embodiments of the present invention. For example, an interchangeable toy track set can be provided wherein a plurality of interchangeable relay segments are provided each of which may be coupled to each other to create a plurality of variations for the toy track set and each of plurality of interchangeable relay segments having a first actuator; a second interchangeable actuator; a conduit fluidly coupling the first actuator to the second actuator; and a release mechanism moveably secured to the first actuator for movement between a first position and a second position wherein movement of the release mechanism from the first position towards the second position causes the first actuator to force a fluid through the conduit, wherein the fluid forced through the conduit by the first actuator causes the second actuator to actuate a second release mechanism.

While the present invention has been described in terms of specific embodiments, it should be appreciated that the spirit and scope of the invention is not limited to those embodiments. The features, functions, elements and/or properties, and/or combination and combinations of features, functions, elements and/or properties of the present invention may be claimed in this or a related application. All subject matter which comes within the meaning and range of equivalency of the claims is to be embraced within the scope of such claims.

What is claimed is:

1. A relay for a toy track set, the relay comprising:

a first actuator in a first plane;

a second actuator in a second plane vertically elevated from the first plane;

a conduit fluidly coupling the first actuator to the second actuator; and a release mechanism moveably secured to the first actuator for movement between a first position and a second position wherein movement of the release mechanism from the first position towards the second position causes the first actuator to force a fluid through the conduit, wherein the fluid forced through the conduit by the first actuator causes the second actuator to actuate a second release mechanism, wherein the first actuator is coupled to a first vehicle track segment and the second actuator is coupled to a second vehicle track segment.

2. The relay as in claim 1, wherein the first vehicle track segment is pivotally mounted to the first actuator and a second vehicle track segment is pivotally mounted to the second actuator.

3. The relay as in claim 1, wherein the first actuator further comprises a piston slidably received within a cylinder, the piston being capable of movement between a first position and a second position wherein movement of the piston from the first position to the second position causes fluid to be forced from the cylinder into the conduit and then into the second release mechanism.

4. The relay as in claim 3, wherein the piston is secured to a rod and movement of the rod causes movement of the piston and movement of the piston towards the first position causes a biasing member to be compressed and apply a biasing force to the piston and the release mechanism being configured to retain the piston in the first position and movement of the release mechanism from the first position to the second position releases the biasing force and the piston is moved towards the second position.

5. The relay as in claim 4, wherein the second release mechanism further comprises a bellows that is inflated when the piston moves from the first position to the second position.

6. The relay as in claim 5, wherein the conduit is a flexible tube and the conduit is the only item coupling the first actuator to the second actuator.

7. The relay as in claim 1, wherein the conduit is a flexible tube and the conduit is the only item coupling the first actuator to the second actuator.

8. The relay as in claim 1, wherein the second actuator has an actuatable member the moves from a first position to a second position when the fluid is received from the conduit and the second actuator is configured to be releasably secured to a track segment.

9. The relay as in claim 1, wherein the second actuator has a moveable member the moves from a first position to a second position when the fluid received from the conduit causes a bellows to be inflated by the fluid.

10. The relay as in claim 9, wherein the moveable member has an angled surface for engaging a conically shaped trigger pivotally secured to the second actuator, wherein the fluid received from the first actuator will cause the movable member to move from an un-actuated position to an actuated position wherein a contact surface of the movable member engages a conically shaped surface of the conically shaped trigger such that conically shaped trigger moves upwardly and releases another spring biased actuator.

11. The relay as in claim 10, wherein the another spring biased actuator launches a vehicle along a vehicle track segment secured to the second actuator and the movable member is biased into the un-actuated position by a spring disposed within the second actuator.

12. The relay as in claim 10, wherein the conically shaped trigger further comprises a manual release for moving the trigger from the first position to the second position.

13. The relay as in claim 1, wherein the conduit is the only item coupling the first actuator to the second actuator.

14. An interchangeable toy track set, comprising:

a plurality of interchangeable relay segments each of which may be coupled to each other to create a plurality of variations for the toy track set, each of plurality of interchangeable relay segments comprising:

a first actuator in a first plane;

a second actuator in a second plane vertically elevated from the first plane;

a conduit fluidly coupling the first actuator to the second actuator; and a release mechanism moveably secured to the first actuator for movement between a first position and a second position wherein movement of the release mechanism from the first position towards the second position causes the first actuator to force a fluid through the conduit, wherein the fluid forced through the conduit by the first actuator causes the second actuator to actuate a second release mechanism, wherein the conduit is the only item coupling the first actuator to the second actuator.

15. The interchangeable toy track set as in claim 14, wherein the first actuator further comprises a piston slidably received within a cylinder, the piston being capable of movement between a first position and a second position wherein movement of the piston from the first position to the second position causes fluid to be forced from the cylinder into the conduit and then into the second release mechanism.

16. The interchangeable toy track set as in claim 15, wherein the piston is secured to a rod and movement of the rod causes movement of the piston and movement of the piston towards the first position causes a biasing member to be compressed and apply a biasing force to the piston and the release mechanism being configured to retain the piston in the first position and movement of the release mechanism from the first position to the second position releases the biasing force and the piston is moved towards the second position.

17. The interchangeable toy track set as in claim 16, wherein the second release mechanism further comprises a bellows that is inflated when the piston moves from the first position to the second position.

18. An interchangeable toy track set, comprising:

a plurality of interchangeable relay segments each of which may be coupled to each other to create a plurality of variations for the toy track set, each of plurality of interchangeable relay segments comprising:

a first actuator in a first plane;

a second actuator in a second plane vertically elevated from the first plane;

a conduit fluidly coupling the first actuator to the second actuator; and a release mechanism moveably secured to the first actuator for movement between a first position and a second position wherein movement of the release mechanism from the first position towards the second position causes the first actuator to force a fluid through the conduit, wherein the fluid forced through the conduit by the first actuator causes the second actuator to actuate a second release mechanism, wherein the first actuator is coupled to a first vehicle track segment and the second actuator is coupled to a second vehicle track segment.

19. The interchangeable toy track set as in claim 18, wherein the first vehicle track segment is pivotally mounted to the first actuator and the second vehicle track segment is pivotally mounted to the second actuator.

* * * * *